United States Patent [19]

Bradshaw et al.

[11] 4,105,135

[45] Aug. 8, 1978

[54] CLOSURE PLUG

[75] Inventors: William A. Bradshaw, Weston; Gerald Dalgleish, St. Catharines, both of Canada

[73] Assignee: American Flange & Manufacturing Co. Inc., Linden, N.J.

[21] Appl. No.: 769,862

[22] Filed: Feb. 18, 1977

[51] Int. Cl.[2] ..... B65D 41/04

[52] U.S. Cl. ..... 220/288; 220/304

[58] Field of Search ..... 220/288, 304, 256; 215/295, 305, 296; 74/553, 557; 16/121

[56] References Cited

U.S. PATENT DOCUMENTS

| | | | |
|---|---|---|---|
| 1,218,753 | 3/1917 | Forg | 74/553 |
| 2,031,351 | 2/1936 | Rheem | 220/256 |
| 2,286,175 | 6/1942 | Wackman | 220/256 |
| 2,411,149 | 11/1946 | Dodson | 220/256 |
| 2,773,621 | 12/1956 | Hurley | 220/288 |
| 2,842,282 | 7/1958 | Parish, Jr. et al. | 220/256 |

FOREIGN PATENT DOCUMENTS

| | | | |
|---|---|---|---|
| 600,229 | 2/1926 | France | 220/228 |
| 664,776 | 8/1938 | Fed. Rep. of Germany | 220/288 |
| 369,110 | 3/1932 | United Kingdom | 220/288 |

*Primary Examiner*—William Price
*Assistant Examiner*—Allan N. Shoap

[57] ABSTRACT

A threaded metal closure plug and closure combination for liquid storage containers, such plug being specially formed for receiving a hand applied torque force. The plug is cup shaped with a bottom wall surrounded by an upstanding cylindrical sidewall, the lower major portion of which is threadedly engaged within an upstanding container opening neck. The upper end of the plug sidewall forms a seat for a resilient sealing gasket and that end terminates in a circumferential outwardly extending lip having a peripheral free edge. Portions of that free edge are deformed downwardly at circumferentially spaced intervals to form radially outwardly facing hand gripping surfaces for convenient and effective hand rotation of the plug.

1 Claim, 5 Drawing Figures

CLOSURE PLUG

BACKGROUND OF THE INVENTION

A need has arisen for a hand tightenable metal screw threaded closure plug to be used primarily in a metal container specially constructed for the temporary storage of materials, particularly combustible fluids. In order to satisfy this need such plug must be capable of easy hand manipulation to produce effective closing under normal circumstances without the aid of any tool or wrench. Threaded steel closure plugs such as commonly employed on steel shipping containers are designed to be actuated by using a wrench. As such, they do not normally lend themselves to effective direct hand manipulation.

SUMMARY OF THE INVENTION

The instant invention responds to the above mentioned need by providing a very simple yet effective closure plug ideally suited for use for closing the openings in various types and sizes of fluid storage containers. The invention plug advantageously incorporates special gripping surfaces to which a substantial torque force can be easily applied by the unaided hand without fear of injury. Should it be desired to tighten the plug down to a greater, controlled extent for preventing unauthorized hand actuation or to resist loosening in the transporting of the container, this can be effected by using a wrench for further tightening. These ends have been achieved by forming a cup shaped metal plug with a bottom wall surrounded by an upstanding cylindrical sidewall whose lower, major portion is threaded. The upper portion of the plug sidewall above the thread is formed into a seat for receiving a resilient sealing gasket. That upper portion terminates in a radially outwardly extending lip. The peripheral free edge portion of such lip is deformed downwardly at circumferentially spaced intervals forming actuating surfaces for the application of substantial torque to the plug by hand engagement. They also serve for wrench engagement should greater torque be desired.

It is, accordingly, a principal object of the invention to provide an integrally formed threaded metal closure plug for use in closing the openings in fluid storage containers.

Another object is to provide such a closure plug constructed to facilitate easy and effective hand manipulation in applying and removing the plug to or from a container opening neck.

Still another object is to provide such a plug which may be applied and tightened further by means of a wrench.

Other and more detailed objects will in part be obvious and in part pointed out as the description of the invention, taken in conjunction with the accompanying drawing proceeds.

Figure 1:
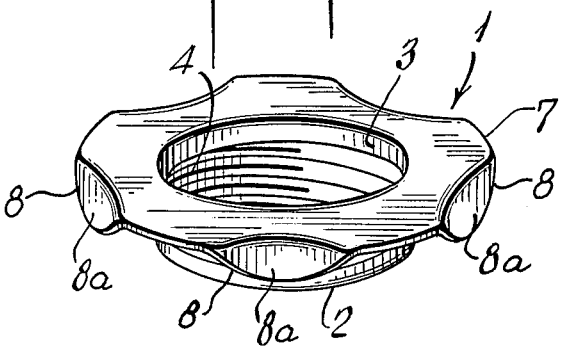
FIG. 1 is a perspective view of the closure plug in accordance with the invention.

The closure plug of the invention, generally indicated at 1 and as shown per se in FIG. 1 has a cup shaped body portion consisting of a flat bottom wall 2 surrounded by an upstanding cylindrical sidewall 3.

A screw thread 4 is formed in the plug sidewall 3 extending upwardly from the bottom wall 2 and joining an unthreaded gasket seat 5 formed out of the upper portion of the sidewall. Such seat extends from the upper end of the screw thread 4 to the undersurface **6*a* of the circumferential lip 6 extending radially outwardly from upper end of the plug sidewall 3**.

Figure 2:
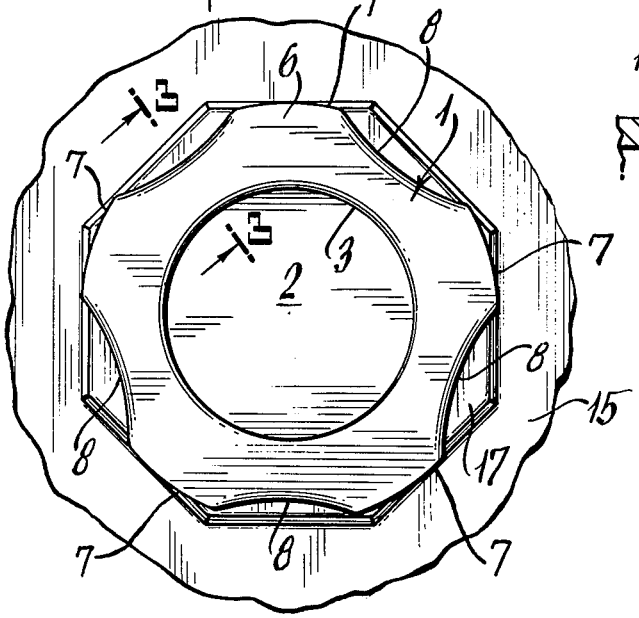
FIG. 2 is a top plan view of such closure plug secured within the container wall opening neck.

The lip 6 extends radially outwardly to a scalloped edge made up of five free edge portions 7 separated by five downwardly formed scallops 8 concaved inwardly as seen at **8*a*. The scallops 8 are well spaced from the wall 3 with each radially outwardly facing surface 8*a* being curved about a vertical axis creating a double-concave relationship with the opposing section of the plug sidewall 3 as clearly seen in FIG. 2. The plug fabrication is completed with the provision of a resilient sealing gasket 9 seated on the gasket seat 5 and initially extending between the seat 5 and surface 6*a***.

Turning to the container wall opening neck construction, a closure bushing or flange 10 is provided with an upstanding cylindrical neck 11 internally threaded at 12 and surrounded at its lowermost end by a polygonally shaped base 13. A resilient sealing gasket 14 is seated at the juncture of the flange neck 11 and base 13. The flange 10 is inserted within an opening in a container wall 15 defined by an upwardly drawn collar 16 surrounding the flange neck 11. The container wall 15 is also embossed at the base of the collar 16 into a raised polygonal recess 17 closely receiving the flange base 13. Permanent securing of the flange 10 within the above described container wall formation in a leakproof manner is achieved by curling the upstanding end of the flange neck radially outwardly into a rounded bead 18 overlying and tightly encasing the uppermost end **16*a* of the collar 16. The bead 18 provides a smooth inwardly facing surface 18*a* for the seating of the gasket 9 thereagainst as seen in FIGS. 3 and 4**.

Figure 3:
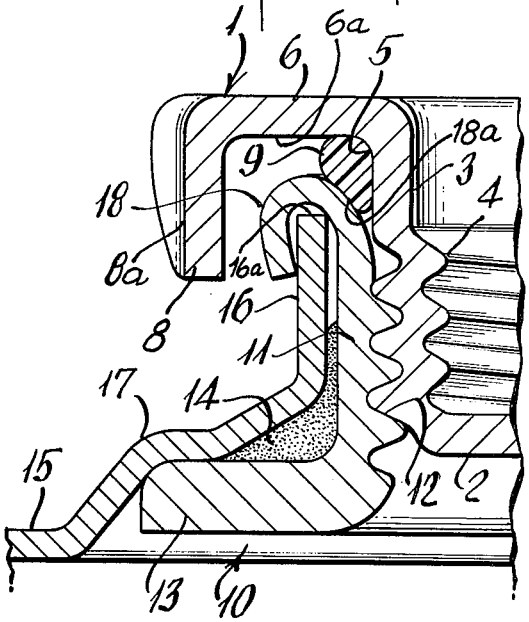
FIG. 3 is an enlarged fragmentary sectional view taken along line 3—3 in FIG. 2 and looking in the direction of the arrows with the plug shown as secured hand tight.

As can be clearly seen in FIG. 3, the plug 1 is threadedly engaged within the flange neck 11. This can readily be done by engaging ones hand with the scalloped portions 8 and screwing the plug down into the flange. Upon contacting the flange bead 18 at **18*a* the plug gasket 15 becomes deformed and flows so as to fully close off any leakage path between the plug and the flange under no more force than can readily be applied by ones unaided hand. For storage purposes this closure, as shown in FIG. 3**, is entirely adequate.

The formation of the plug head or lip with its above described rounded surfaces is such that the hand and fingers are protected from injury during hand application of the plug. The smooth rounded surfaces of the plug lip are easily gripped and the plug manipulated even with a heavily gloved hand. Furthermore, the scalloped portions of the plug head overlie the container wall and extend well below the plug gasket seat 5 to prevent contact of the hand with the opening neck.

Figure 4:
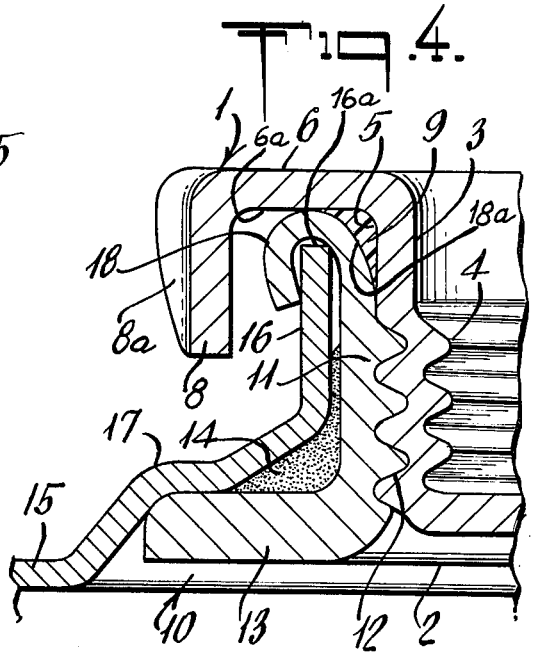
FIG. 4 is a view similar to FIG. 3 but showing the relationship between the plug and opening neck after further tightening by the application of a wrench.
Figure 5:
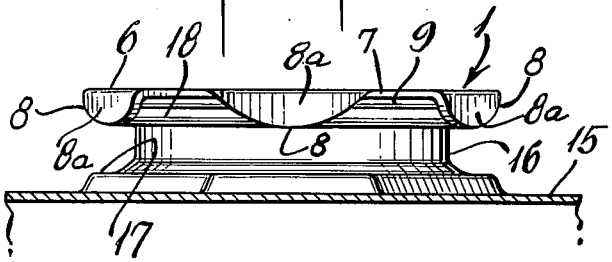
FIG. 5 is a front elevation of the plug secured in hand tightened position in a container wall opening neck.

In FIG. 4 the seating relationship between the flange and plug is shown when the plug has been torqued down with the aid of a wrench applied to the plug lip.

Here the plug is turned all the way down until the undersurface 6a of the plug lip 6 comes into engagement with the top of the flange bead 18, at this position the gasket 9 is further deformed, flowing part way up between the bead portion 18a and the surface 6a and down towards the commencement of the flange and plug threads. The gasket is thus surrounded by the metal and serves to protect the plug from loosening from such as the vibrations encountered during shipment of the container. Thus the plug of the invention is fully effective for the closing of the container during shipment but is also fully adequate for hand closing and opening of the container in the hands of the ultimate consumer.

Changes in and modifications of the construction and different embodiments of the invention would suggest themselves to those skilled in the art and could be made without departing from the spirit or scope of the invention. It is accordingly intended that all matter contained in the above description or shown in the accompanying drawing shall be interpreted as being illustrative and not in a limiting sense.

We claim:

1. A container closure combination comprising a container wall opening surrounded by an internally threaded upstanding cylindrical neck terminating at its uppermost end in an outwardly curled bead, a cup shaped closure plug threadedly engaged within said opening, said plug having a bottom wall surrounded by an upstanding cylindrical threaded sidewall, an annular gasket seat at the upper end of said sidewall, a resilient sealing gasket disposed on said seat, a circumferential lip extending radially outwardly from the uppermost end of said plug sidewall terminating in a peripheral free edge portion, said peripheral free edge portion being deformed downwardly at circumferentially spaced intervals so as to form with said plug sidewall a series of downwardly opening channel shaped sections separated by remaining segments of said radially extending free edge portion, each of said sections extending downwardly to a position vertically spaced below said gasket seat and presenting a radially outwardly facing torque applying surface for convenient hand rotation of said plug, said outwardly facing torque applying surface being curved radially inwardly for effective hand gripping and forming a doubleconcave relationship with the interior of said plug sidewall.

* * * * *